US007014599B2

(12) United States Patent
Ashley

(10) Patent No.: US 7,014,599 B2
(45) Date of Patent: Mar. 21, 2006

(54) SELECTABLE FORCE EXERCISE MACHINE

(76) Inventor: Peter Ashley, 31 Alexander Rd., Hopkinton, MA (US) 01748

( * ) Notice: Subject to any disclaimer, the term of this patent is extended or adjusted under 35 U.S.C. 154(b) by 468 days.

(21) Appl. No.: 10/431,081

(22) Filed: May 7, 2003

(65) Prior Publication Data

US 2004/0224827 A1 Nov. 11, 2004

(51) Int. Cl.
*A63B 23/025* (2006.01)

(52) U.S. Cl. ..... 482/110; 482/99; 482/102

(58) Field of Classification Search ..... 482/148, 482/132, 99, 140, 126, 136, 102, 137, 50, 482/123, 121, 122, 106–108; 474/164–178
See application file for complete search history.

(56) References Cited

U.S. PATENT DOCUMENTS

| | | | | |
|---|---|---|---|---|
| 770,994 | A * | 9/1904 | White | 482/110 |
| 3,638,941 | A | 2/1972 | Kulkens | |
| 4,231,568 | A * | 11/1980 | Riley et al. | 482/130 |
| 4,603,855 | A | 8/1986 | Sebelle | |
| 4,620,704 | A | 11/1986 | Shifferaw | |
| 4,643,420 | A | 2/1987 | Riley | |
| 5,336,150 | A | 8/1994 | Mueller | |
| 5,382,212 | A | 1/1995 | Davenport | |
| 6,045,491 | A | 4/2000 | McNergney | |
| 6,224,514 | B1 * | 5/2001 | Price | 482/50 |
| 6,283,899 | B1 * | 9/2001 | Charnitski | 482/110 |
| 6,482,139 | B1 | 11/2002 | Haag | |
| 6,638,201 | B1 * | 10/2003 | Dischler | 482/132 |

OTHER PUBLICATIONS bowflex.com—Sales Literature.
soloflex.com —Sales Literature.
Golds Gym —Powerflex www.iconfitness.com/goldsgym/PF/index.html.

* cited by examiner

*Primary Examiner*—Jerome W. Donnelly

(57) ABSTRACT

An exercise machine that outputs constant force from resilient resistances and allows continuously selectable levels of strength training resistance. The machine consists primarily of a pre-biased resistance element (50), a conical pulley structure with eccentric cross section (40), an axially adjustable force attachment point (34) and a frame (10). Flexible force transmission elements (30) conduct force to the user interface elements (16, 17) via pulleys (36).

17 Claims, 4 Drawing Sheets

SELECTABLE FORCE EXERCISE MACHINE

BACKGROUND OF THE INVENTION

1. Field of the Invention

This invention relates to an exercise device utilizing a resistance element for development of muscular strength, size and endurance.

2. Description of Background and Relevant Information

Exercise devices for muscular strength training typically employ resistance elements utilizing a gravitational mass or resilient materials. Exercise devices utilizing a gravitational mass resistance element exhibit the highly desirable characteristic of providing a constant resistance force throughout the range of exercise movement. However, the high weight of a gravitational resistance element causes considerable difficulties in shipping and on site mobility of the exercise device. Resilience based exercise machines such as the Bowflex™ (U.S. Pat. No. 4,620,704) and Soloflex™ (U.S. Pat. No. 4,587,320) therefore dominate the direct sales market.

Exercise devices based on resilient materials, although light, suffer from the problem of a varying resistance force. Resistance increases progressively during the exercise stroke as the elongation or compression of the resilient medium increases. A resistance too low for maximal muscular development occurs over most of the exercise stroke. Designs to convert a resilient resistance to constant force are often complicated (U.S. Pat. No 5,382,212). Other designs fail to adequately deal with the large ratio of force possible with a resilient element with zero initial resistance.

Adjustment of the exercise force is a crucial factor in the success of strength training devices. Resistance should be adjustable to accommodate different exercises and users. Users also need to increase resistance over time for an exercise movement as strength develops. Most resilient exercise machines, such as the Bowflex™ and Soloflex™, allow resistance to be changed by selectively engaging different resistance elements, or by adding resistance elements in parallel. Adjusting resistance in this way is time consuming and only permits resistance changes in fixed increments, usually 5 lbs at a time. Tension must be removed from the resistance elements to effect the change, so the exercise stroke begins at a minimal resistance level.

Another method of adjusting resistance of a resilient resistance involves varying the force attachment point along a lever arm (U.S. Pat. No. 3,638,941). Lever arm arrangements suffer from a few problems. First, the lever arm modifies the input resistance force according to a cosine function. This results in greatest force transmission when the level position is perpendicular to the input force, and lower forces elsewhere along the arc of the lever arm. Second, lever arms are not space efficient.

An exercise device that solves these problems efficiently could be produced at lower cost, allowing more consumers to experience the benefits of strength training and muscular development. An easy to use mechanism for adjusting resistance force can reduce workout times and increase opportunities for strength progression. Constant force allows a user to perform more exercise work during a stroke.

BRIEF DESCRIPTION OF THE INVENTION

The invention is an exercise machine containing a rotary force transmission device that compensates for the varying force of a resilient resistance and also allows adjustment of output resistance force of the resilient resistance. The force transmission device combines an eccentric cross section that compensates for the increasing resistance of a spring, with a conical shape that allows selection of the effective size of the eccentric. A moveable mounting point allows the position of force attachment to be selected without affecting the total working length of the flexible force transmission cables. Adjustment can be accomplished with minimum force and without introducing slack into the force transmission system. A pre-biased resistance element allows the system to deliver a constant output force.

OBJECTS AND ADVANTAGES

It is an object of the invention to compensate for the increasing force of a resilient resistance during compression or tensioning movements, so as to produce a more constant output force.

It is an object of the invention to provide a simple mechanism for adjusting the output force delivered to the user from a single fixed resistance, without introducing unwanted modifications to the force such as a cosine multiplier.

It is an object of the invention to provide an infinitely adjustable output force of the system.

An advantage of the invention is that the working length of the flexible transmission mechanisms used in the machine is constant with no problems of slack management. It is an object of the invention to achieve these goals in a simple machine, with a minimal part count, that is inexpensive to manufacture.

An advantage provided by the simple structure of the invention is that frictional losses are minimized, so negative exercise movements receive a high force relative to positive movement effort.

It is an object of the invention to allow selection of force output from a single resilient resistance and without requiring the resilient resistance to be in a zero tension state.

REFERENCE NUMERALS IN DRAWINGS

Figure 1:
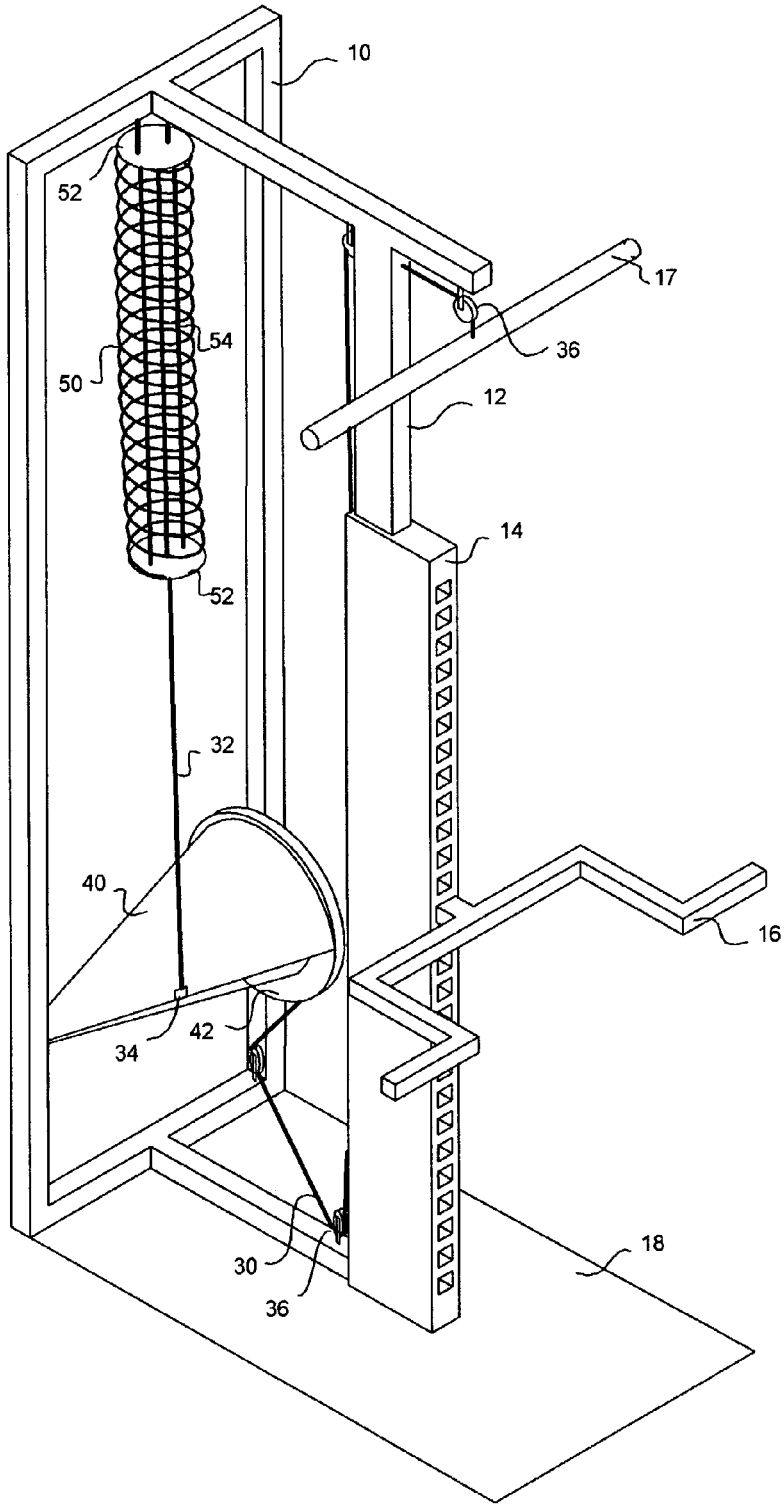
FIG. 1—An isometric view of the preferred embodiment of the device.

10 Frame
12 Vertical track member
14 Grip attachment rack
16 Hand grip
17 Pull down bar
18 Stabilizing base plate
30 User force transmission cable
32 Resistance force transmission cable
34 Resistance force attachment mount
35 Crimp clamp
36 Pulley
40 Eccentric cone
42 Cone pulley
44 Cone axel
46 Fixed size eccentric pulley
48 Circular cone
50 Spring
52 Spring retention endplate
54 Spring tension retainers
60 Channel track
61 Cable sheath
62 Force adjustment cable
63 Torsion reel spring
64 Selector fork
65 Selector guide
66 Selector control rod
67 Interlocking ribbed code

DETAILED DESCRIPTION OF THE PREFERRED EMBODIMENT

The preferred embodiment of the present invention is shown in FIG. 1. A frame 10 provides a structure to support tension or compression of a resilient exercise resistance 50. The frame is mounted on a stabilizing base plate 18. The base plate is further stabilized by the user's weight during use. A vertical track member 12 is attached to the frame. A grip attachment rack 14 moves along the vertical track member. The grip attachment rack can only move vertically. Rollers or bushings in the grip attachment rack reduce friction with the vertical track member. The grip attachment rack contains numerous holes to allow insertion of a hand grip 16 at different points, for different sized people and exercises. A second plate internal to the grip attachment rack contains matching holes, and fixes the hand grip in a horizontal plane. Detents in the hand grip at the point of insertion prevent accidental removal under load. Different styles of grips and user interface elements, such as shoulder pads for squats, can replace the basic hand grip.

A pulldown bar 17 is mounted to allow chinning and other downward stroke exercises. The pulldown bar is attached to a user force transmission cable 30. This cable runs over pulleys 36 and attaches to the grip attachment rack. The user force transmission cable is further routed through additional pulleys to the large cone pulley 42. The cone pulley is connected directly to the eccentric cone 40, and both revolve around an axel 44 inserted laterally into the frame.

The eccentric cone contains an embedded channel track 60, which allows a resistance force attachment mount 34 to slide laterally along the edge of the cone. The resistance force attachment cable 32 is connected to the force attachment mount and the resistance spring. The eccentric cone tapers from an outer diameter matching the cone pulley to a small diameter. Lateral movement of the attachment mount in the track allows selection of the user's effective leverage from 1:1 to high values. The attachment mount moves laterally with ease under resting slack conditions. Tension in the system applies torsion to the mount, preventing changes to the selected leverage under working conditions. The slide track may have periodic detents and a measure scale to provide positive confirmation of a selection points along the track.

User exercise force and motion is conducted to the cone pulley producing rotation of the cone pulley and eccentric cone. Resistance to the eccentric cone's rotation occurs as the force resistance cable winds around the eccentric cone. The cone pulley is sized at about 12 inches in diameter. Thus a typical exercise movement, requiring withdrawal of 2 to 3 feet of cable, produces less than one rotation of the cone pulley. The eccentric pulley is shaped so that as it rotates, the effective diameter also shrinks. This compensates for an increase in force due to increasing compression of the resistance spring.

To produce a constant exercise resistance, the decrease in radius occurring for a cross section of the eccentric cone can be matched to the spring characteristics. The resistance spring in the preferred embodiment is initially pre-compressed between two spring retention endplates 52. The endplates are connected together by spring tension retainer 54 rods. The retainer rods prevent expansion of the spring end plates but allow further compression and constrain the compression path. The resistance force transmission cable is connected to one end plate and passes through a guide hole in the other before attaching to the force attachment mount on the eccentric cone. Assuming the spring tension increases 100% from initial tension to maximum excursion caused by a full rotation of the eccentric cone, the eccentric cone's effective diameter should be sized to shrink 50% to compensate. Initial spring resistance will determine maximum output resistance at the 1:1 selection setting, so an initial resistance of 200–300 lbs will work well for most users. Additional pulleys could or a smaller cone diameter be used to reduce the spring compression stroke, in order to allow a reduction in spring size.

Figure 2:
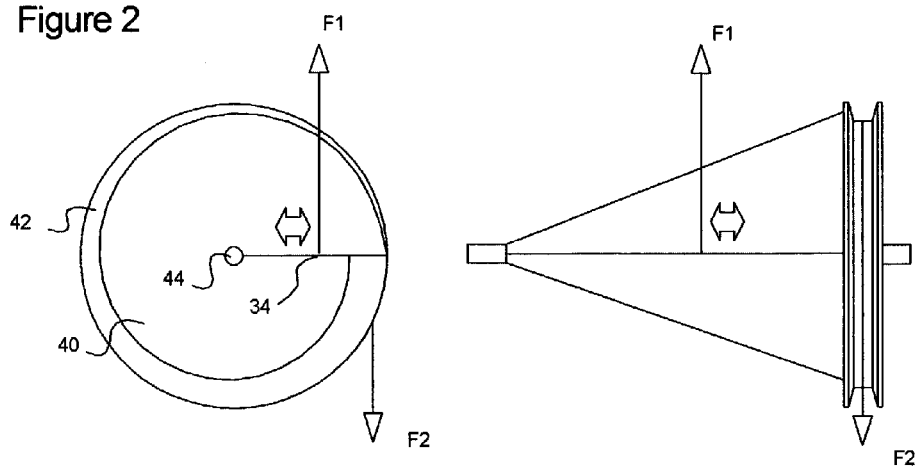
FIG. 2—Side and front views of the eccentric cone of the force transmission system.
Figure 3:
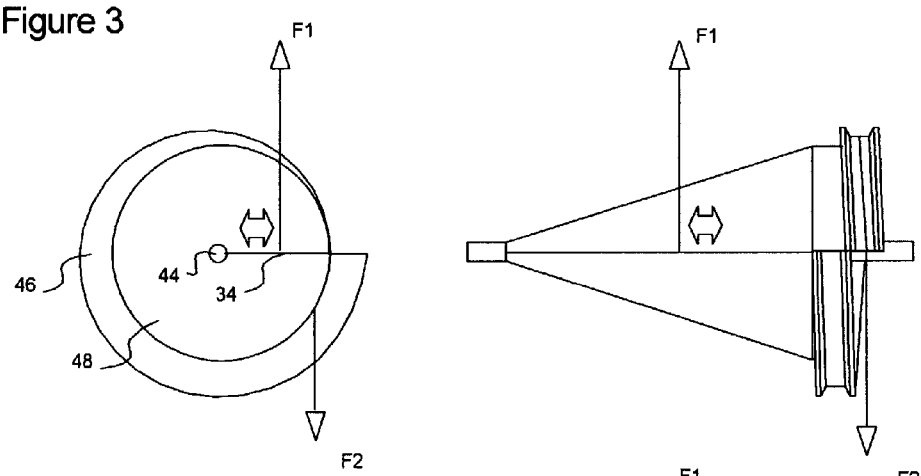
FIG. 3—Side and front views of a circular cone and eccentric pulley.
Figure 4:
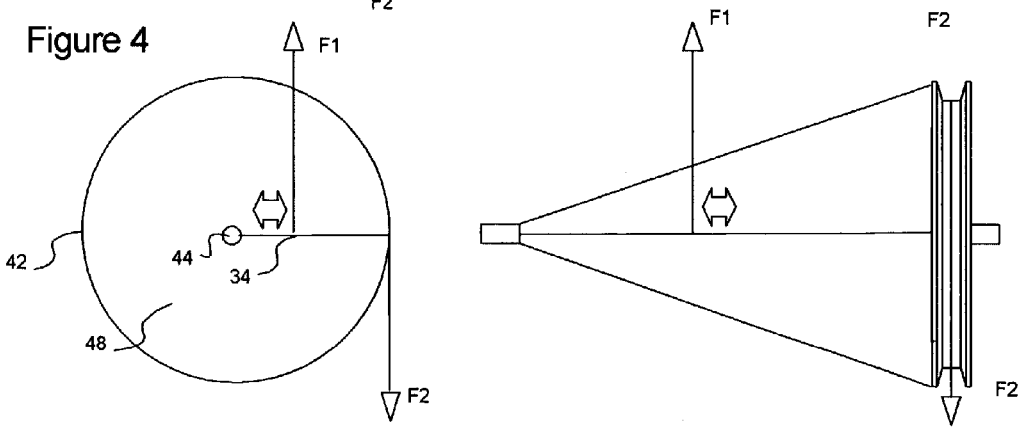
FIG. 4—Side and front views of a circular cone and pulley.

FIG. 2 shows a close up of the eccentric cone with force transmission points illustrated. The length of the eccentric cone should be at least 150% of the diameter of the cone pulley. This length minimizes unintended changes in resistance output due to the resistance force transmission cable wrapping across, or slipping down, the cone. Use of plastic or resin materials allows economical manufacture of the eccentric cone and cone pulley by molding processes. FIG. 3 shows an alternate form of the force transmission cone, with a circular cross section cone 48 and an eccentric cone pulley element 46. The eccentric pulley element increases in radius as rotation increases from the start position. FIG. 4 shows an alternate form of the force transmission cone, with a constant diameter cone and pulley. This embodiment would be useful for varying resistance of a fixed but constant force resistance, such as a vacuum cylinder or fixed weight.

Figure 5:
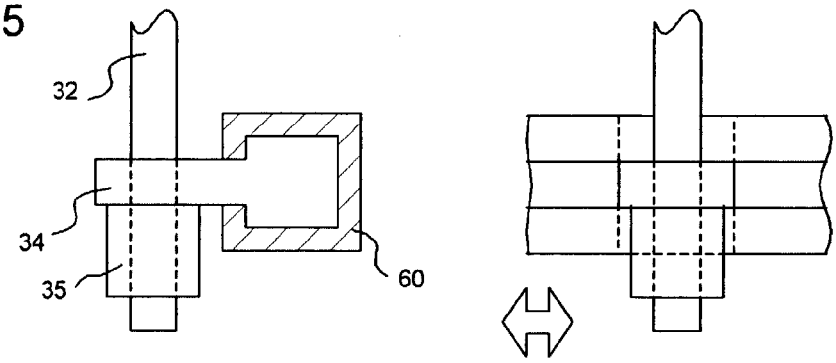
FIG. 5—Side and front views of the force attachment device and channel.

FIG. 5 shows a close up side and front view of the resistance force attachment mount. The mount is enclosed within a C shaped channel track, which allows lateral movement within the channel. The force transmission cable runs through a hole in the force attachment mount and is secured with a compression crimp clamp 35. The attachment mount may be equipped with a handle to assist direct force selection by the user.

Figure 6:
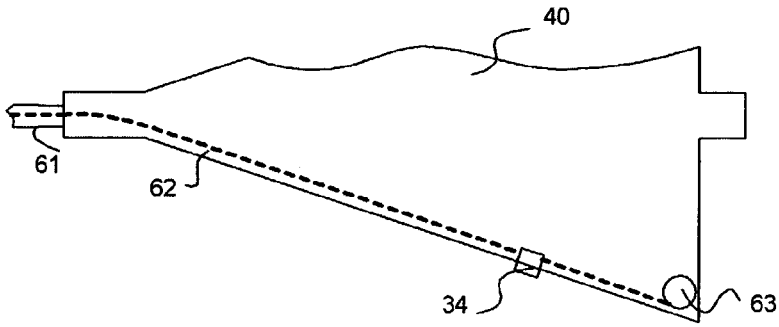
FIG. 6—Top view of force selection controlled remotely by cable.

Remote selection of the lateral position of the force transmission mount may be desirable for convenience or to minimize user exposure to the working elements. FIG. 6 depicts a top view of the eccentric cone, and a means of remotely controlling the position of the force attachment mount via a cable 62 running in a sheath 61. The cable enters through the axel, allowing the cable to accept twisting without involvement of the sheath. The cable connects to the force attachment mount. A torsion reel spring 63 returns the force attachment mount to the far position if the user relieves tension on the cable.

Figure 7:
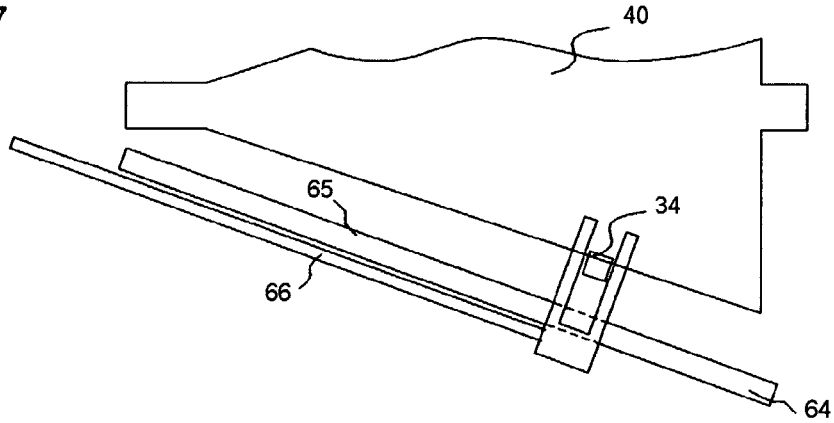
FIG. 7—Top view of force selection controlled remotely by selector fork.

FIG. 7 shows a top view of a mechanism for controlling the force attachment mount with a selector fork 64. The selector fork moves laterally along a selector guide 65 rail. The position of the force attachment mount is maintained between the tines of the fork. The fork can be cam shaped and mounted on a pivot, to allow continued engagement during rotation of the eccentric cross section. The selector fork is moved remotely via a selector control rod 66 attached to the fork.

Figure 8:
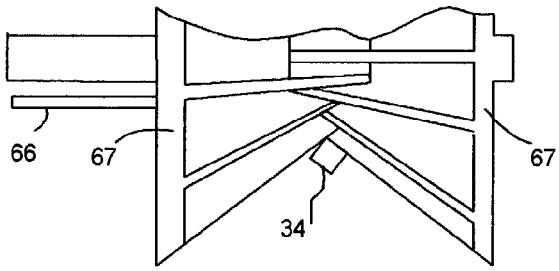
FIG. 8—Top view of force selection controlled remotely by interlocking cones.

FIG. 8 shows a top view of a selection mechanism having two steeply tapering cones, where the force attachment point will be drawn to the intersection of the two cones by tension or a torsion reel spring. The cones can overlap because they aren't solid, but are constructed of offset, interlocking ribs. One of the cones can move laterally on the axel, with its position controlled by a selector rod. These cones can also be eccentrically shaped.

Figure 9:
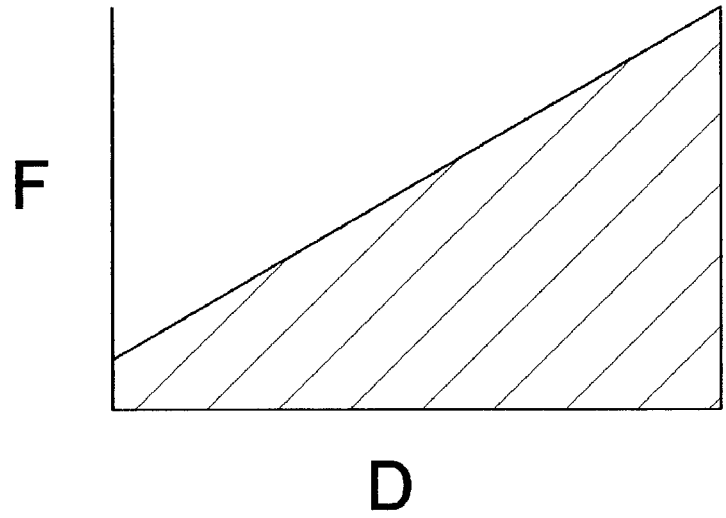
FIG. 9—Graph of work performed during stroke with typical spring machine.
Figure 10:
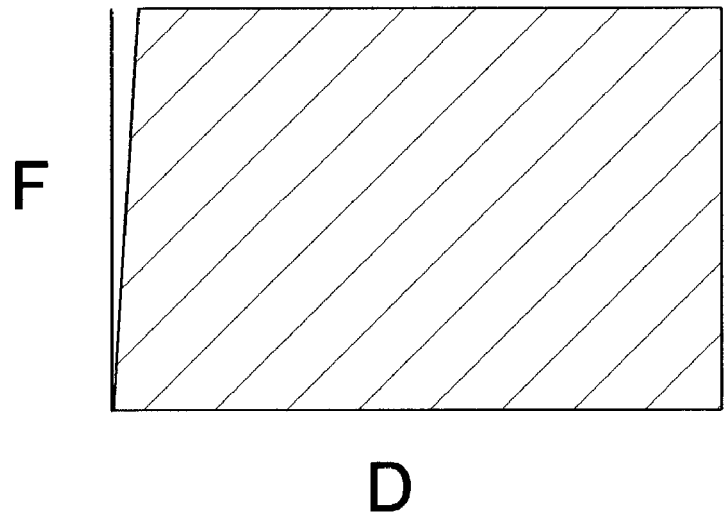
FIG. 10—Graph of work performed during stroke with the invention.

FIG. 9 shows the work (integral of force over distance) performed during a exercise stroke with the resilient exercise devices that dominate the market currently. Work is constrained by the low initial starting resistance and the maximum force the user can deliver. FIG. 10 shows the increased work performed during a stroke with the invention. Resistance can be delivered at the user's maximum tolerated force throughout the repetition. Increased exercise workload translates into increased exercise effectiveness.

SUMMARY: RAMIFICATIONS AND SCOPE

Accordingly, significant improvements in exercise machine performance can result from use of the invention. The invention will allow use of a single fixed input resistance to produce a continuously selectable output force. Resistance selection can be quickly accomplished with minimum effort. Resistance level is easily changed, even for a resilient resistance biased to produce significant initial output force. The invention compensates for the progressive force characteristic of a resilient resistance over an exercise movement. A constant output force feels natural and maximizes the work performed by a user's muscles. The design of the invention minimizes problems of slack management within the machine. The simple design of the machine can allow low cost manufacture and distribution, increasing the penetration of strength training products in the market and increasing availability for lower income consumers.

Although the descriptions above contain many specificities, these should not be construed as limiting the scope of the invention, but merely as providing illustrations of the some of the presently preferred embodiments of the invention. Thus the scope of the invention should be determined by the appended claims and their legal equivalents, rather than by the examples given.

What is claimed is:

1. An exercise machine comprising:

a resistive load means a frame for supporting said resistive load means, a pulley element, an eccentric cone attached to said pulley element said eccentric come including an embedded channel track, a movable interface element, a resistance force attachment mount, a first flexible force transmission element and a second force transmission element, said second force transmission element having attached thereto said resistance force attachment mount; and wherein said first flexible force transmission element is attached to and between said user interface element and said pulley element and said second force transmission element is attached between said resistive load means on one end and at a second end to said embedded channel track of said eccentric cone to thereby allow lateral movement of the attachment mount with respect to said track of said eccentric cone.

2. The moveable interface of claim 1 wherein the interface consists of an attachment point for said flexible force transmission elements that can be moved perpendicular to, or in the radius of, said flexible elements to minimize slack required in said elements.

3. The attachment point of claim 2 wherein the attachment point is remotely selected by a cable.

4. The interface of claim 1 wherein the interface can be controlled by a selector fork.

5. The interface of claim 1 wherein the interface can be selected by a coaxial conical or disk element.

6. The pulley element of claim 1 wherein the effective radius changes during rotation to tailor the effective force transmission ratio to compensate for the changing load provided by the resistive means across the exercise stroke.

7. The pulley element of claim 1 wherein the effective radius changes during rotation to tailor the effective force transmission ratio across an exercise stroke to optimize the biomechanical workload on the user's muscles.

8. The pulley element of claim 1 wherein the effective radius changes during rotation to tailor the effective force transmission ratio across an exercise stroke to compensate for axial movement of the flexible force transmission means.

9. The resistive load means of claim 1 wherein the resistive load element is comprised of a coil, leaf, rotary, torsion or other spring element in tension or compression.

10. The resistive load means of claim 9 wherein the resistive load element is pre-biased to minimize the change in radius of the force transmission element required.

11. The biased load element of claim 10 wherein the element can be interchanged along with the biasing means as a unit.

12. The resistive load means of claim 1 wherein the resistive load element is comprised of an elastomeric material.

13. The resistive load means of claim 12 wherein the resistive load element is pre-biased to minimize the change in radius of the force transmission element required.

14. The resistive load means of claim 1 wherein the resistive load element is a mass.

15. The resistive load means of claim 1 wherein the resistive load element consists of a piston in a cylinder operating against differential gas pressures.

16. The piston element of claim 15 wherein the piston contains a vacuum.

17. The resistive load means of claim 1 wherein the resistive load element may be comprised of a plurality of loads selectable individually or in parallel.

* * * * *